US007314009B2

(12) United States Patent
Wunsh et al.

(10) Patent No.: US 7,314,009 B2
(45) Date of Patent: Jan. 1, 2008

(54) DISPLAY DEVICE

(75) Inventors: Craig Wunsh, Bondi Junction (AU); Craig Lazarus, Bondi Junction (AU); Sandy Richardson, Bondi Junction (AU)

(73) Assignee: Creatable Media Group, Inc., Woodland Hills, CA (US)

( * ) Notice: Subject to any disclaimer, the term of this patent is extended or adjusted under 35 U.S.C. 154(b) by 125 days.

(21) Appl. No.: 10/757,782

(22) Filed: Jan. 15, 2004

(65) Prior Publication Data

US 2005/0155529 A1 Jul. 21, 2005

(51) Int. Cl.
*A47B 85/00* (2006.01)

(52) U.S. Cl. ..... 108/25; 108/90

(58) Field of Classification Search ..... 108/25, 108/26, 27, 12, 14, 13, 90, 161; 206/769, 206/770, 3.26; 70/12, 13, 77, 78, 158, 159, 70/160

See application file for complete search history.

(56) References Cited

U.S. PATENT DOCUMENTS

| | | | | | |
|---|---|---|---|---|---|
| 796,855 | A * | 8/1905 | Nurick | 108/90 |
| 1,575,954 | A * | 3/1926 | Walaschek | 108/90 |
| 1,738,429 | A * | 12/1929 | Heyman | 108/90 |
| 3,212,952 | A * | 10/1965 | Turner | 108/161 |
| 3,610,175 | A * | 10/1971 | Wilton et al. | 108/161 |
| 4,150,630 | A * | 4/1979 | Pokorny et al. | 108/64 |
| 4,484,745 | A * | 11/1984 | Sleeper | 108/161 |
| 4,821,651 | A * | 4/1989 | Peng | 108/90 |
| 4,841,878 | A * | 6/1989 | Kriegsman | 108/90 |
| 4,905,611 | A * | 3/1990 | Jung-Chung | 108/90 |
| 5,123,527 | A * | 6/1992 | Hustad | 206/769 |
| 5,327,838 | A * | 7/1994 | Beltman | 108/25 |
| 5,342,057 | A | 8/1994 | Sorkoram | |
| 5,603,410 | A * | 2/1997 | Kara | 206/769 |
| 5,634,411 | A | 6/1997 | Chasan | |
| 5,697,305 | A | 12/1997 | Chasan et al. | |
| 5,778,800 | A * | 7/1998 | Liang | 108/50.11 |
| 6,014,935 | A * | 1/2000 | Willett | 108/90 |
| 6,123,031 | A * | 9/2000 | Hayman-Chaffey | 108/27 |
| 6,367,392 | B2 * | 4/2002 | Moore | 108/90 |
| 6,450,341 | B1 * | 9/2002 | Krupa et al. | 206/497 |
| 6,450,343 | B1 * | 9/2002 | Arnaldi | 206/769 |
| 6,499,411 | B2 * | 12/2002 | Brown | 108/90 |
| 6,739,271 | B1 * | 5/2004 | Hancock | 108/90 |
| 6,823,804 | B2 * | 11/2004 | Arnell | 108/90 |
| 2003/0071545 | A1 | 4/2003 | Fink | |

FOREIGN PATENT DOCUMENTS

| | | |
|---|---|---|
| AU | 200231466 | 7/2002 |
| FR | 2276649 | 1/1976 |

* cited by examiner

*Primary Examiner*—José V. Chen
(74) *Attorney, Agent, or Firm*—Seyfarth Shaw LLP; Joseph P. Quinn

(57) ABSTRACT

A display device including a tabletop provided with a transparent portion; an interior space for holding an advertisement to be viewed through the transparent portion; the tabletop is secured with a lock barrel which operates a cam to move a flange laterally into and out of engagement with a recess.

5 Claims, 8 Drawing Sheets

DISPLAY DEVICE

TECHNICAL FIELD

This invention relates to a display device in the form of a tabletop in which can be displayed advertising material.

The present invention is especially useful for displaying articles such as advertisements in a table top or similar opaque surface and it will therefore be convenient to describe the device in relation to that application.

The display device of the present invention may be used in commercial or domestic locations such as shopping centres, restaurants, food courts, food halls, retail shops, airports, hospitals, public transport stations, lobbies, hotels/motels etc.

BACKGROUND TO THE INVENTION

It is well known to provide for placement of advertising material in a tabletop in public places such as cafes, shops and bars. Display devices for this purpose are exemplified by the devices described in Australian Patent application AU200231466 and French Patent FR2276649.

The device described in AU200231466 adopts a well known principle of displaying an article under a transparent surface as is seen in for example, counter tops, display cases, tourist information desks and allows an advertisement to be removably retained beneath a viewing window in a tabletop. However, in order to remove and replace advertisements it is necessary to unscrew various threaded fasteners to allow removal of a plug from beneath the tabletop. With this mechanism it is time consuming to replace an advertisement held within the tabletop.

The device described in FR2276649 allows for the top surface of the table top to be lifted up in a hinging action to access the advertisement from above. The top surface is retained by an elastic clip at an edge opposite the hinged edge. Hence, unauthorised opening of the tabletop may easily be made by releasing the elastic clip.

SUMMARY OF THE INVENTION

In a first aspect the present invention provides a display device including a first member including a tabletop provided with a transparent portion; a second member arranged to cooperate with the first member to define an interior space for holding an article to be viewed through the transparent portion; the first and second members are arranged to be selectively engaged together or disengaged by way of lockable operating means, the operating means being operable from a position outside the interior space.

In this way, the first member can be swiftly disengaged from the second member to allow introduction of an article to the interior space for viewing and the members are then engaged together and are locked. Persons cannot tamper with the article because it is locked inside the device.

The first and second members may engage together by way of two opposed retaining means.

Each retaining means may include a flange and a mating aperture and at least one of the flanges is movable between an engaged and a disengaged position.

Each flange may be disposed on the second member and each recess may be disposed on the first member.

The flanges may face outwardly from one another.

The operating means may include a rotary lock barrel which is arranged to rotate a cam.

Each flange may be engageable with either recess. This allows the first member to be engaged in two orientations with the second member. This assists with rapid engagement of the first and second members.

Rotation of the cam may cause lateral movement of a locking bar upon which one of the flanges is disposed.

In a second aspect the present invention provides a display arrangement including a tabletop having an interior space for holding an article; the tabletop includes a transparent portion allowing viewing of the article; the article including an information bearing sheet and a three dimensional object; the information bearing sheet includes a cut-out portion through which the object may be viewed.

In this way, information relating to the article may be provided on the sheet associated with the article and may draw attention to features of the article.

The object may be a product and the sheet may bear information relating to that product.

The display arrangement may include a supporting means including a flat portion for supporting the sheet, and a depressed portion for supporting the object.

The supporting means may be biased towards the transparent portion.

The supporting means may be biased by compressible material.

The supporting means may be in the form of a removable tray.

A display device according to the first aspect of the invention may be used in a display arrangement according to the second aspect of the invention.

A display arrangement according to the second aspect of the invention may include a display device according to the first aspect of the invention.

In a third aspect the present invention provides a tabletop for use with a display arrangement, the tabletop having a transparent portion through which an article may be viewed and two opposed recesses that allow engagement of the tabletop to a fixed support.

In a fourth aspect the present invention provides a base portion for a display arrangement, the base portion including a base plate provided with two outwardly facing flanges that allow engagement of an overlying tabletop member, at least one of the flanges being movable to selectively engage or disengage the overlying tabletop member.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
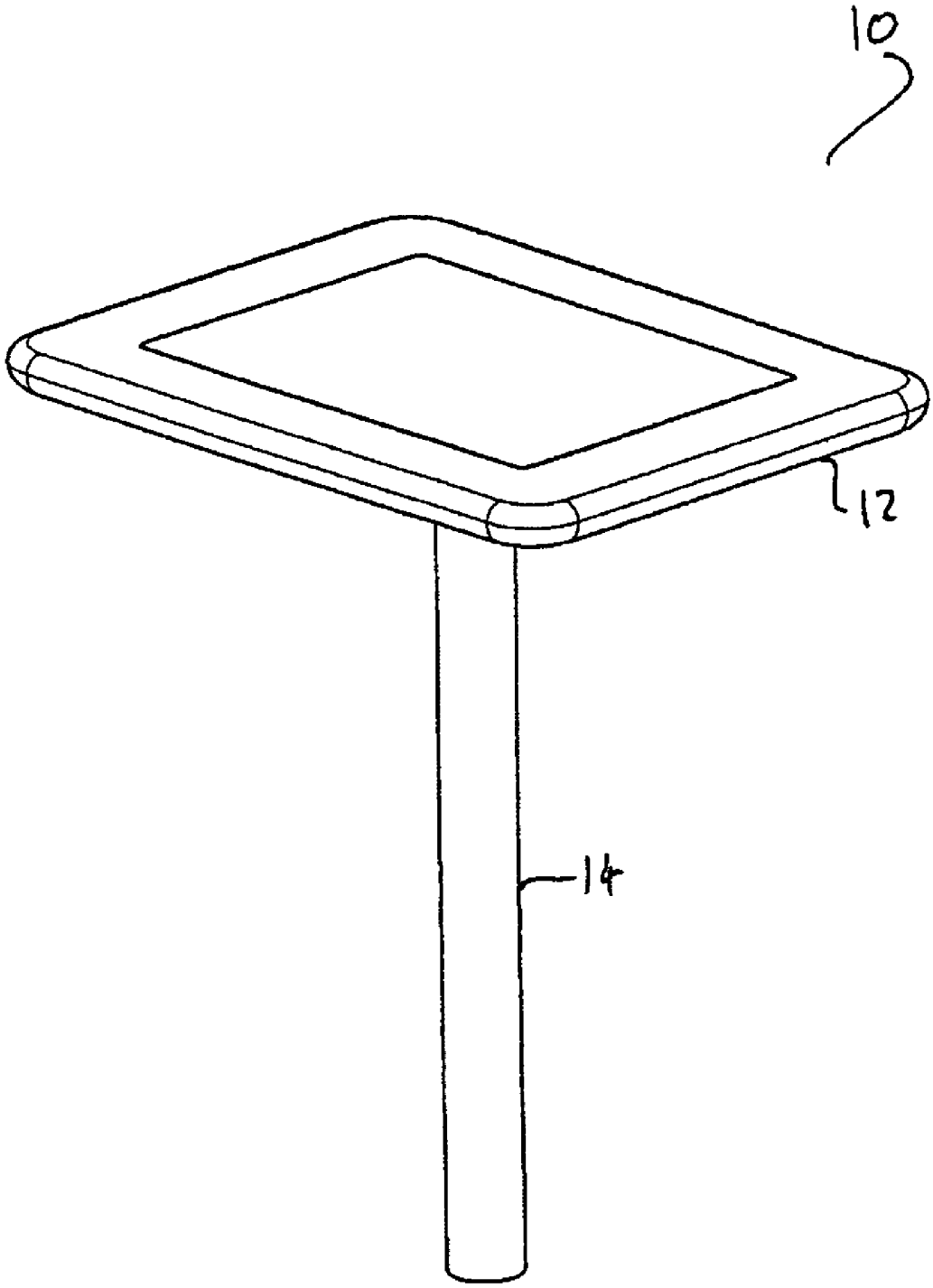
FIG. 1 is a perspective view of an embodiment of a display device according to the present invention.

Referring to FIG. 1, a display device 10 is shown including a first member in the form of tabletop 12 and a second member in the form of base portion 14. Tabletop 12 is provided with a transparent portion in the form of window 16. The tabletop and base member define an interior space for holding an article to be viewed through window 16 and may be selectively engaged together or disengaged to allow access to the interior space as will now be described.

Figure 2:
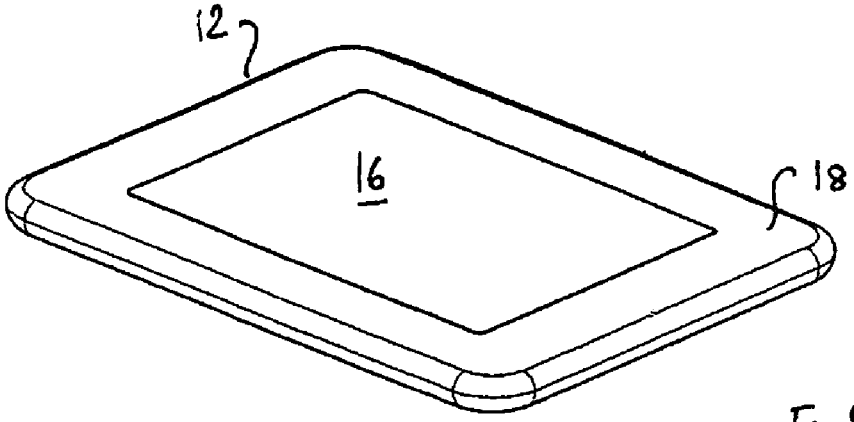
FIG. 2 is a perspective view of the tabletop of the display device of FIG. 1.

Referring to FIG. 2, tabletop 12 includes window 16 which is formed from a transparent material such as acrylic, polyester, an acrylic/polyester mixture, glass or other suitable transparent material.

Tabletop 12 further includes a frame 18 surrounding window 16. Frame 18 is formed from an opaque material such as a "solid surface material" as is known in the art, including material such as that sold under the name Corian by DuPont. Such materials are typically formed from a moulding mix including a polymer binder and inert fillers. The polymer binder may include vinyl ester, polyester, acrylic, epoxy, polyurethanes, phenolic, melamine a polyester/acrylic mixture or other suitable binding compounds. The fillers may include inert minerals such as alumina, quartz, granite, marble, glass, etc. Indeed, window 16 may be formed from such a "solid surface material" that has been prepared to be transparent.

Window 16 is fixed into frame 18 by methyl methacrylate. Any suitable adhesive can be used such as an acrylic, polyester or other suitable binding compound to provide a smooth and uninterrupted tabletop surface.

Referring to FIGS. 4 to 8, frame 18 includes two identically shaped apertures 20, the function of which will be later described.

Figure 3:
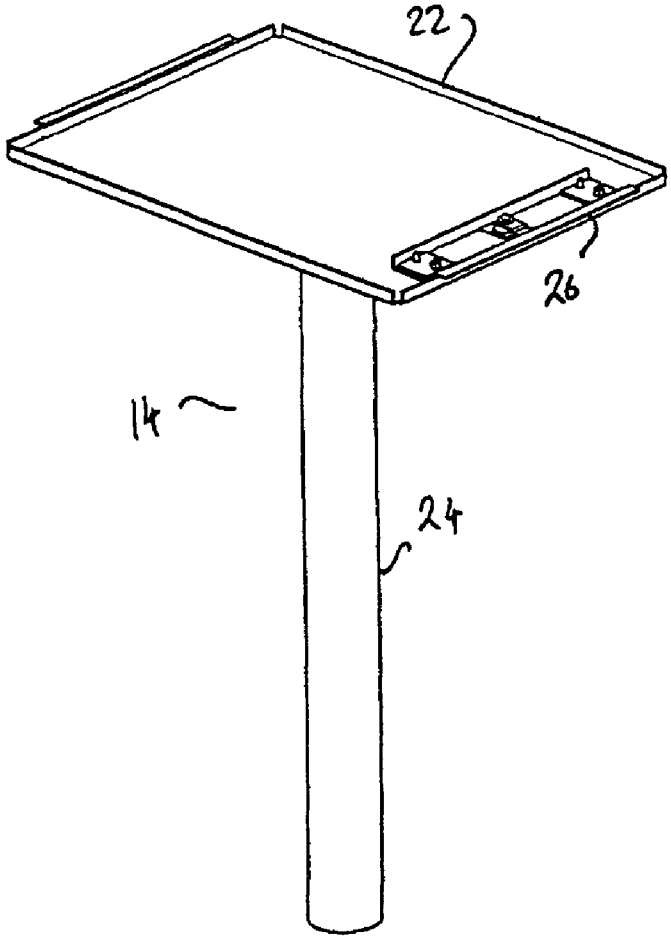
FIG. 3 is a perspective view of the base portion of the display device of FIG. 1.
Figure 4:
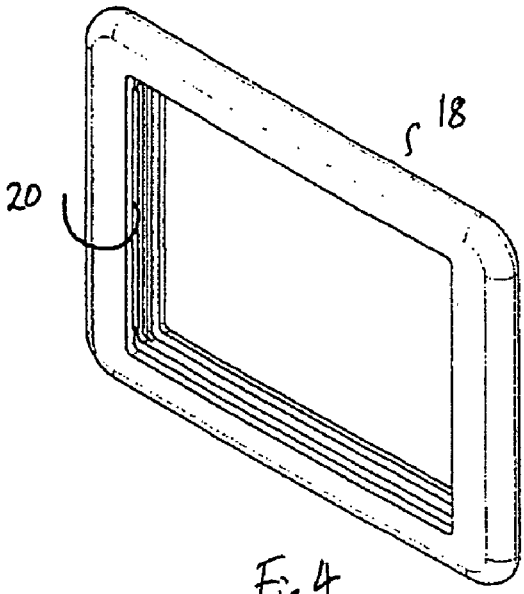
FIG. 4 is an underside perspective view of the frame of the tabletop of FIG. 2.
Figure 5:
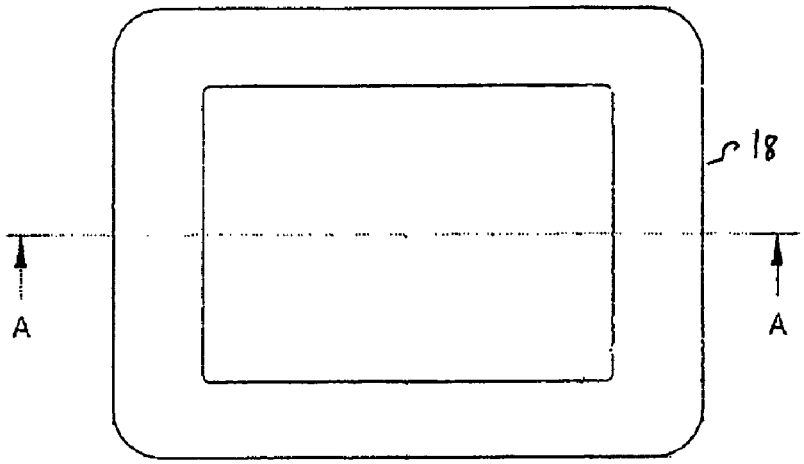
FIG. 5 is a plan view of the frame of FIG. 4.
Figure 6:
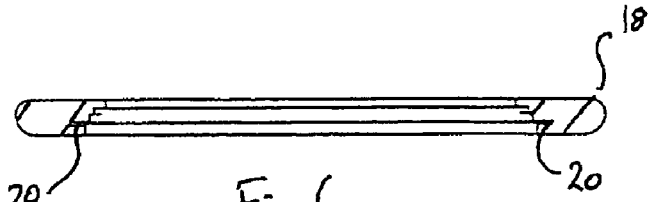
FIG. 6 is a cross section view along the line A-A of FIG. 5.
Figure 7:
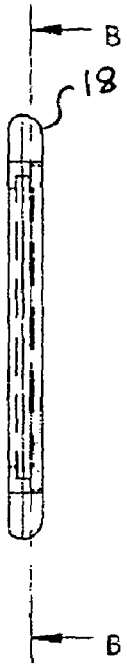
FIG. 7 is side view of the frame of FIG. 4.
Figure 8:
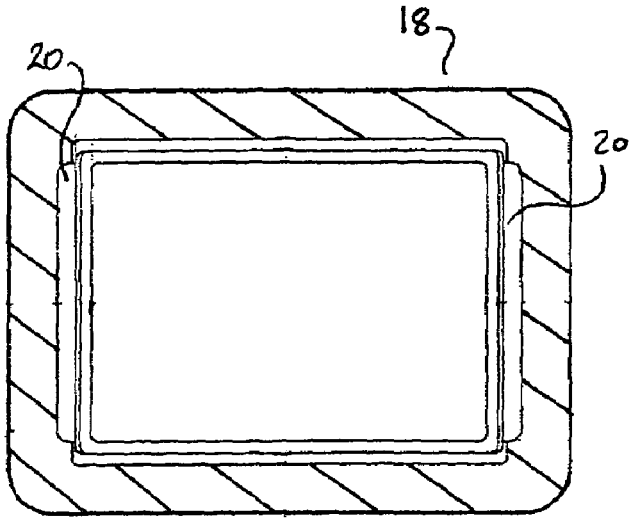
FIG. 8 is a cross section view along the line B-B of FIG. 7.

Referring to FIG. 3, base portion 14 is shown including base plate 22, locking bar 26 and supporting leg 24. The supporting leg 24 is affixed to base plate 22 by nuts and bolts in a conventional manner and serves to maintain tabletop 12 at a desired height and location in use.

Figure 9A:
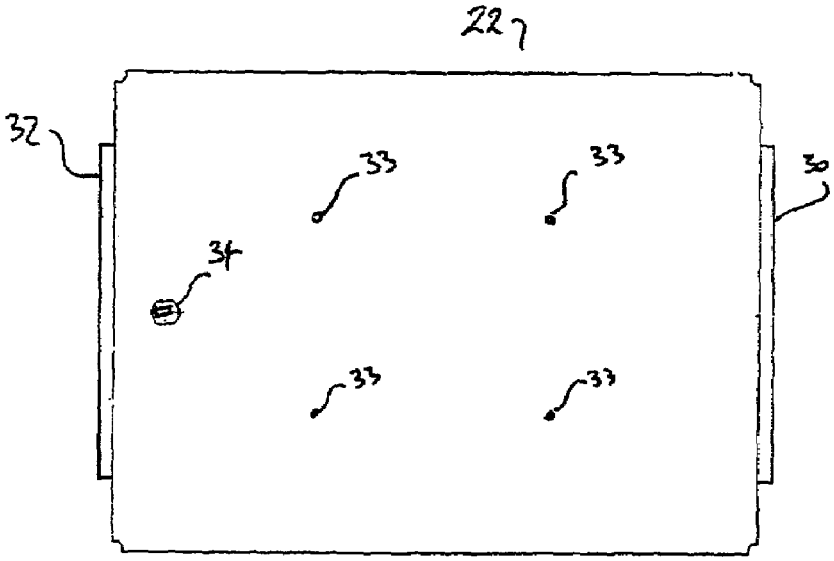
FIG. 9A is an underside view of the base portion of FIG. 9.
Figure 9:
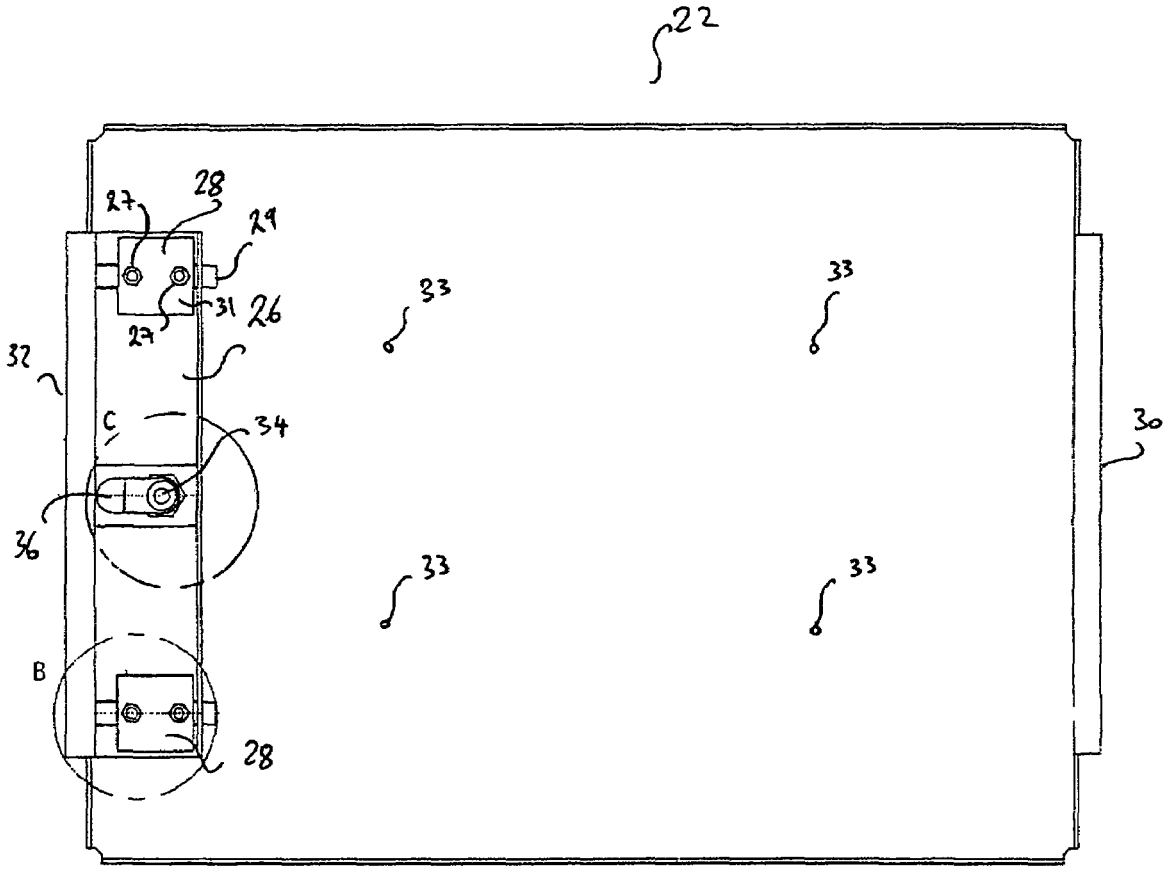
FIG. 9 is a plan view of the base portion of FIG. 3 shown in the locked position.

Referring to FIGS. 9 and 9A, base portion 14 is shown in detail and with supporting leg 24 removed. Locking bar 26 is slidably connected to base plate 26 by way of mountings 28. Each mounting is made up of a pair of pillars 27, a small steel strip 29 and plate 31. Slots 25 in locking bar 26 fit over strips 29 to locate locking bar 26. Plate 31 is fixed to pillars 27 with nuts and is spaced away from locking bar 26 by the pillars to allow lateral movement of locking bar 26. A fixed outwardly facing flange 30 is provided, and a similarly shaped outwardly facing flange 32 is provided on locking bar 26. Mounting holes 33 enable base plate 22 to be fixed to supporting leg 24.

Figure 10:
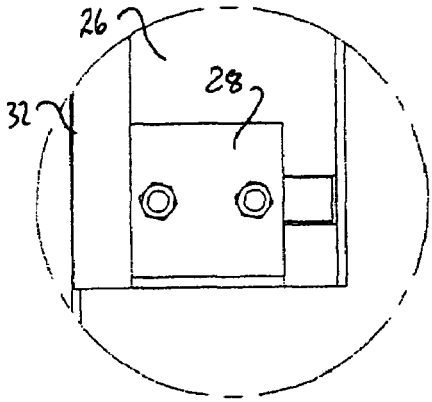
FIG. 10 is an enlarged view of detail B of FIG. 9 in the unlocked position.
Figure 11:
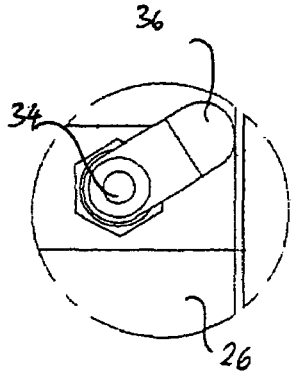
FIG. 11 is an enlarged view of detail C of FIG. 9 in the unlocked position.
Figure 12:
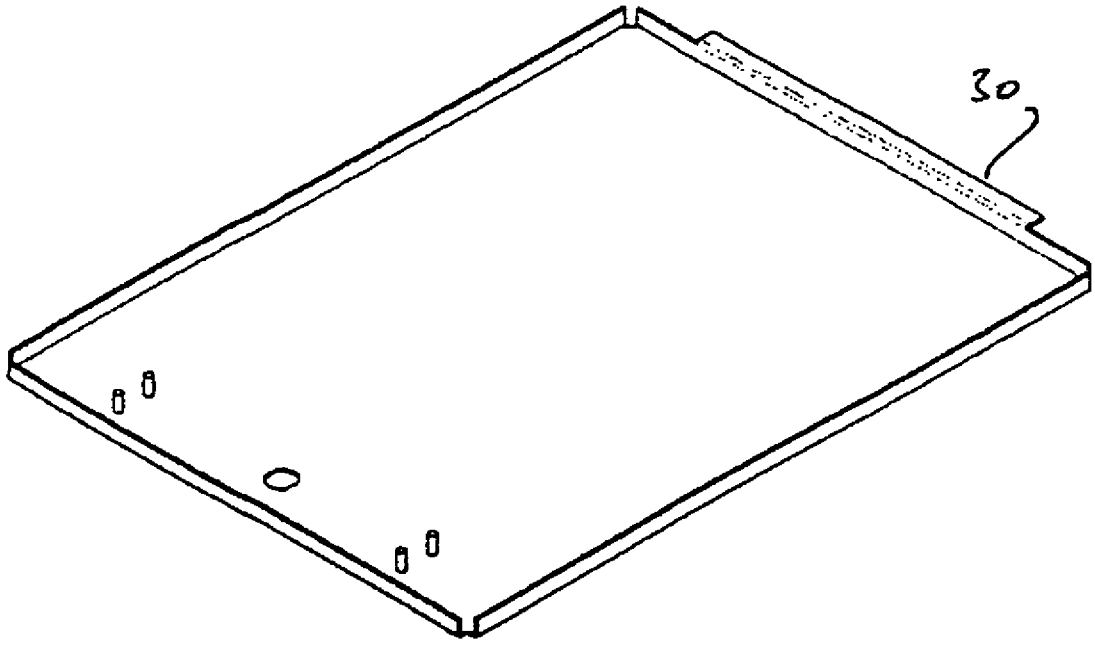
FIG. 12 is a perspective view of the base plate of the base portion of FIG. 3.
Figure 13:
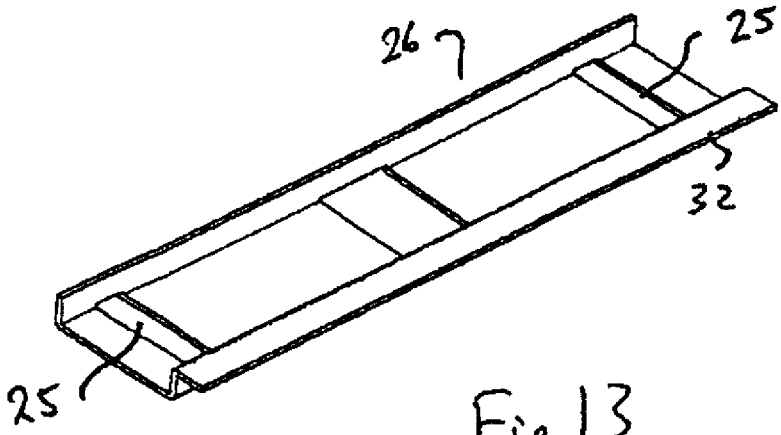
FIG. 13 is a perspective view of the locking bar of the base portion of FIG. 3.

Lockable operating means is provided in the form of rotary lock barrel 34. Lock barrel 34 may be rotated by inserting an appropriate key from the underside of base plate 22 and rotating the barrel. Lock barrel rotates a cam 36 which bears against locking bar 26 to move locking bar laterally with respect to mountings 28. This movement causes movable flange 32 to move between an extended position (see FIG. 9) to engage with tabletop 12 and a retracted position (see FIGS. 10 and 11) to disengage from tabletop 12.

To engage tabletop 12 with base portion 14, lock barrel 34 is rotated to bring locking bar 26 to the retracted position. Tabletop 12 is then fitted to base portion 14 so that fixed flange 30 mates with one of the mating apertures 20. Lock barrel 34 is then rotated to bring locking bar 26 to the extended position causing movable flange 32 to mate with the other aperture 20 and the key is then removed from lock barrel 34. Each pair of flange 30,32 and mating aperture 20 cooperate to act as a retaining means to engage the tabletop 12 with base portion 14. In this way, tabletop 12 can be quickly and securely affixed to base portion 14. Further, each flange 30, 32 may engage with either aperture 20. This allows the tabletop 12 to be affixed to base portion 22 in either of two orientations.

In use, an article to be viewed is positioned in the interior space defined between tabletop 12 and base portion 14. The article may be an information bearing sheet such as a printed advertisement, or it may be a three dimensional article. To gain access to the article, such as for the purpose of replacing the article with a different article the following procedure may be employed.

The key is inserted into lock barrel 34 from below base plate 22. The key is rotated to rotate the lock barrel 34 to rotate cam 36 to cause movement of locking bar 26 to the retracted position, thus withdrawing movable flange 32 from mating aperture 20. Tabletop 12 may then be lifted at the edge near to movable flange 32 in a hinging action about fixed flange 30. The fixed flange and mating aperture are dimensioned to allow hinge type movement to an extent sufficient to allow a person to reach into the interior space to retrieve an article, or to introduce an article. Tabletop 12 is then lowered back to lie on base plate 22 and can then be engaged by rotation of lock barrel 34.

Figure 14:
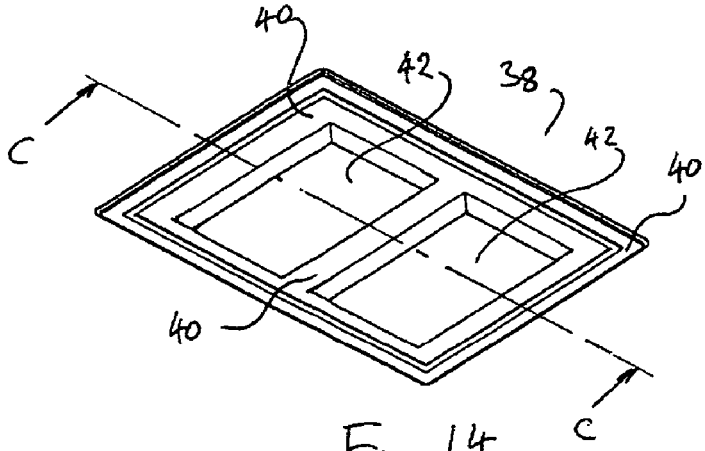
FIG. 14 is a perspective view of a removable tray for use with the display device of FIG. 1.
Figure 15:
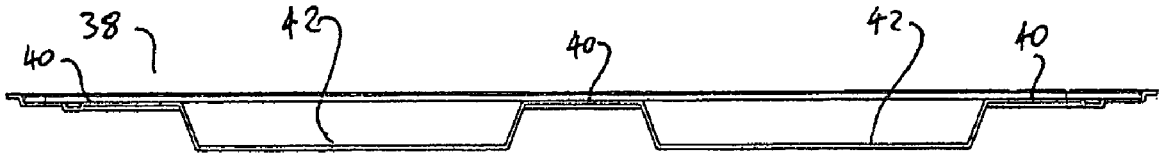
FIG. 15 is a cross section view along the line C-C of FIG. 14.

Referring to FIGS. 14 and 15, a supporting means for supporting one or more articles inside the interior space is shown in the form of plastic removable tray 38. Tray 38 includes a flat portion 40 suitable for supporting an information bearing sheet such as an A3 size piece of paper and depressed portions 42 for supporting a three dimensional object. In use, strips of compressible material in the form of foam rubber are adhered to the underside of tray 38 in the region of depressed portions 42. These compressible strips press against base plate 22 to bias the tray towards the underside of tabletop 12. This ensures that an information bearing sheet supported by the tray is held close to the underside of window 16 for improved viewing and a tidy appearance.

Figure 16:
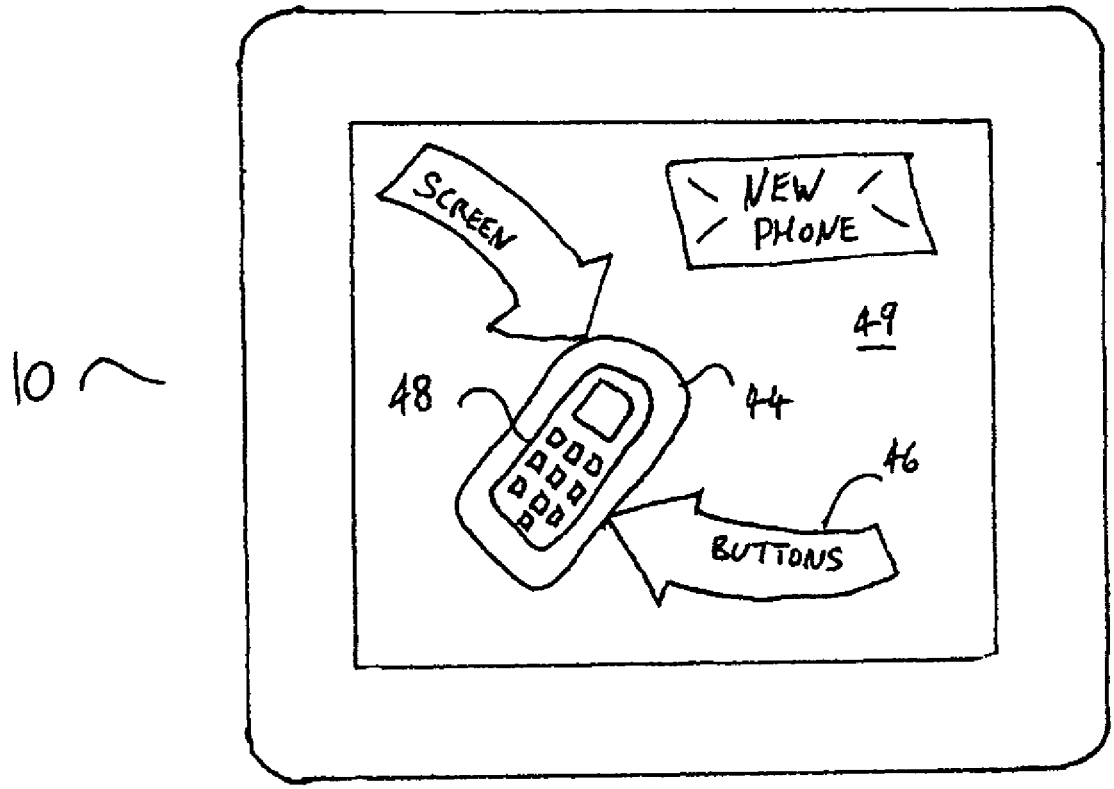
FIG. 16 is a plan view of an embodiment of a display arrangement according to the second aspect of the invention.

Referring to FIG. 16, a display arrangement is shown using the display device of FIG. 1 fitted with the removable tray of FIG. 14. A three dimensional article in the form of mobile phone handset 48 is supported in a depressed portion 42, and an information bearing sheet in the form of printed sheet 49 is supported on flat portion 40. A cut out portion 44 is provided in printed sheet 49 to allow viewing of handset

48. This arrangement can be used to advertise a product where the object is a sample of the product, and the information bearing sheet bears information relating to the product and drawing attention to features of the product. The information bearing portion can draw attention to various features of the product by providing indicating arrows 46 or the like that draw a users attention to a part of the product and provide an associated description to explain the virtues of the product.

In one embodiment, the three dimensional article is kept in place by an adhesive pad placed between the article and the tray. in another embodiment, the recess in the tray is dimensioned to closely fit around the three dimensional article to keep it in place.

In view of the foregoing, it can be seen that the first aspect of the present invention provides a display device that is secure and allows for ready replacement of articles to be displayed.

It can be seen that the second aspect of the invention provides a novel and useful arrangement for displaying articles.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The claims defining the invention are as follows:

1. A display device including:

a first member including a tabletop provided with a transparent portion;

a second member arranged to cooperate with the first member to define an interior space for holding an article to be viewed through the transparent portion;

the first and second members are arranged to be selectively engaged together or disengaged by way of lockable operating means, the operating means being operable from a position outside the interior space;

the first and second members engage together by way of two opposed retaining means;

each retaining means includes a flange and a mating aperture and at least one of the flanges is movable between an engaged and a disengaged position;

the operating means includes a rotary lock barrel, a locking bar, and a cam;

wherein the moveable flange is disposed on the locking bar, the cam is mounted on the rotary lock barrel, and rotation of the rotary lock barrel causes rotation of the cam which in turn causes lateral movement of the locking bar to move the flange laterally to engage or disengage the flange with its respective aperture.

2. A display device according to claim 1 wherein each flange is disposed on the second member and each recess is disposed on the first member.

3. A display device according to claim 2 wherein the flanges face outwardly from one another.

4. A display device according to claim 1 wherein each flange is engageable with either recess.

5. A display arrangement further comprising a tabletop having an interior space for holding an article, the tabletop includes a transparent portion allowing viewing of the articles;

the article including an information bearing sheet and a three dimensional object;

the information bearing sheet includes a cut-out portion through which the object may be viewed including a display device according to claim 1.

* * * * *